US006086393A

United States Patent [19]

Tung et al.

[11] Patent Number: 6,086,393

[45] Date of Patent: Jul. 11, 2000

[54] EJECTOR MECHANISM FOR A CARD CONNECTOR

[75] Inventors: Shun-Chi Tung, Tu-Chen; Hung-Chi Yu, Taipei Hsien, both of Taiwan

[73] Assignee: Hon Hai Precision Ind. Co., Ltd., Taipei Hsien, Taiwan

[21] Appl. No.: 09/203,905

[22] Filed: Dec. 1, 1998

[30] Foreign Application Priority Data

Dec. 1, 1997 [TW] Taiwan ..... 86220093

[51] Int. Cl.[7] ..... H01R 13/62

[52] U.S. Cl. ..... 439/159

[58] Field of Search ..... 439/159, 160, 439/157, 152; 361/754

[56] References Cited

U.S. PATENT DOCUMENTS 5,713,750 2/1998 Ho ..... 439/159

*Primary Examiner*—Khiem Nguyen
*Assistant Examiner*—Javaid Nasri

[57] ABSTRACT

A card connector for use with an electrical card, comprises a dielectric housing having a plurality of contacts securely assembled therein. A metal card housing attaches to the dielectric housing defining a space for receiving the electrical card. An ejector mechanism is assembled to the metal card housing for ejecting an inserted card. A guiding device includes a pair of guiding slots defined on the metal card housing, and a pair of guiding tongues integrally formed on an ejection plate of the ejector mechanism. The guiding tongues are moveably received within the guiding slots, wherein when a push rod of the ejector mechanism is moved, the ejector plate is evenly moved to eject the inserted card.

5 Claims, 5 Drawing Sheets

EJECTOR MECHANISM FOR A CARD CONNECTOR

FIELD OF THE INVENTION

The present invention relates to an ejector mechanism, and particularly to a card connector ejector mechanism with a guiding device therein for facilitating withdraw of an inserted card.

DESCRIPTION OF PRIOR ART

Portable or laptop computers are provided with card connectors for receiving an IC card which expands the memory thereof. Each card connector is equipped with an ejector mechanism for ejecting an inserted IC card. The ejector mechanism commonly includes a push bar, an actuator, and an ejection plate whereby when the push bar is activated by a user, the inserted card will be ejected.

The configuration of the ejector mechanism depends on the type of card used with the connector. Taiwan Patent Application No. 83107162 and U.S. Pat. No. 5,456,610 each disclose an ejector mechanism having a cutout defined in a push bar for engaging with a tab of an ejection plate. U.S. Pat. No. 5,421,737 discloses a card ejector mechanism having a pivotal connection between a push rod and a tab of an ejection plate. Taiwan Patent Application No. 83107162 and U.S. Pat. Nos. 5,149,276 and 5,451,168 disclose ejector mechanisms including a third member which links a push rod to an ejection plate. In another embodiment of U.S. Pat. No. 5,451,168 the third member has a retaining portion for connecting with the connector.

The above disclosed ejector mechanisms comprise many components which complicates assembly and results in increased manufacturing costs. In addition, the connection between the push rod and the tab of the ejection plate may become disengaged during actuation of the ejector mechanism. Furthermore, the assembly of the third member between the push rod and ejection plate is difficult and unstable. Among the above described ejector mechanism, an ejection plate is not well guided during withdraw of the inserted card thereby resulting difficult ejection thereof.

Hence, an improved card connector ejector mechanism is requisite to eliminate the above mentioned defects of current card connector ejector mechanisms.

SUMMARY OF THE INVENTION

An objective of this invention is to provide an ejector mechanism with a guiding device for smoothly ejecting an inserted card.

In order to achieve the objective set forth, a card connector for use with an electrical card, comprises a dielectric housing having a plurality of contacts securely assembled therein. A metal card housing attaches to the dielectric housing defining a space for receiving the electrical card. An ejector mechanism is assembled to the metal card housing for ejecting an inserted card. A guiding device includes a pair of guiding slots defined on the metal card housing, and a pair of guiding tongues integrally formed on an ejection plate of the ejector mechanism. The guiding tongues are moveably received within the guiding slots, wherein when a push rod of the ejector mechanism is moved, the ejector plate is evenly moved to eject the inserted card.

These and additional objectives, features, and advantages of the present invention will become apparent after reading the following detailed description of the preferred embodiments of the invention taken in conjunction with the appended drawing figures.

DETAILED DESCRIPTION OF THE PREFERRED EMBODIMENT

Figure 1:
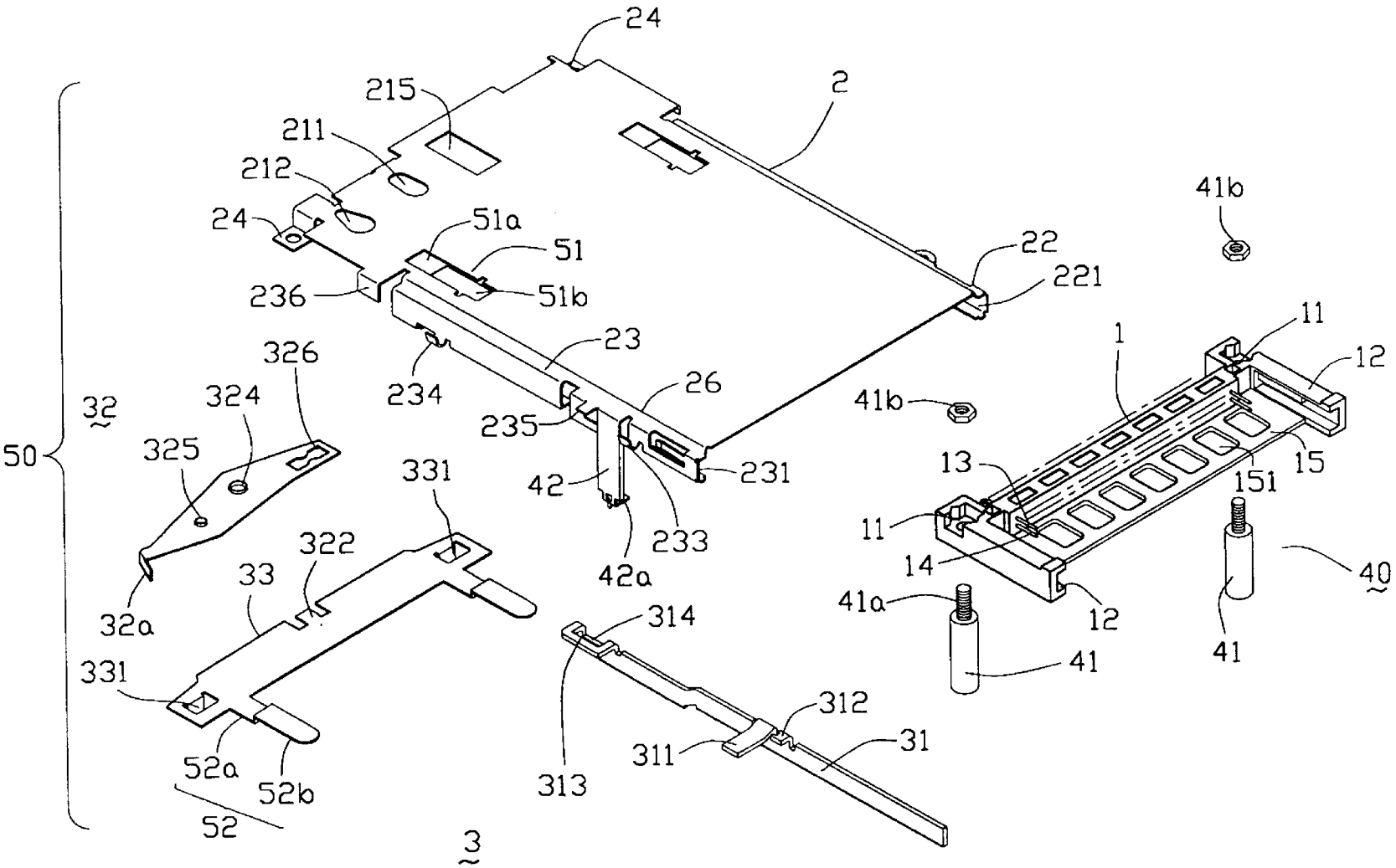
FIG. 1 is an exploded view of a card connector with an ejector mechanism in accordance with the present invention.
Figure 2:
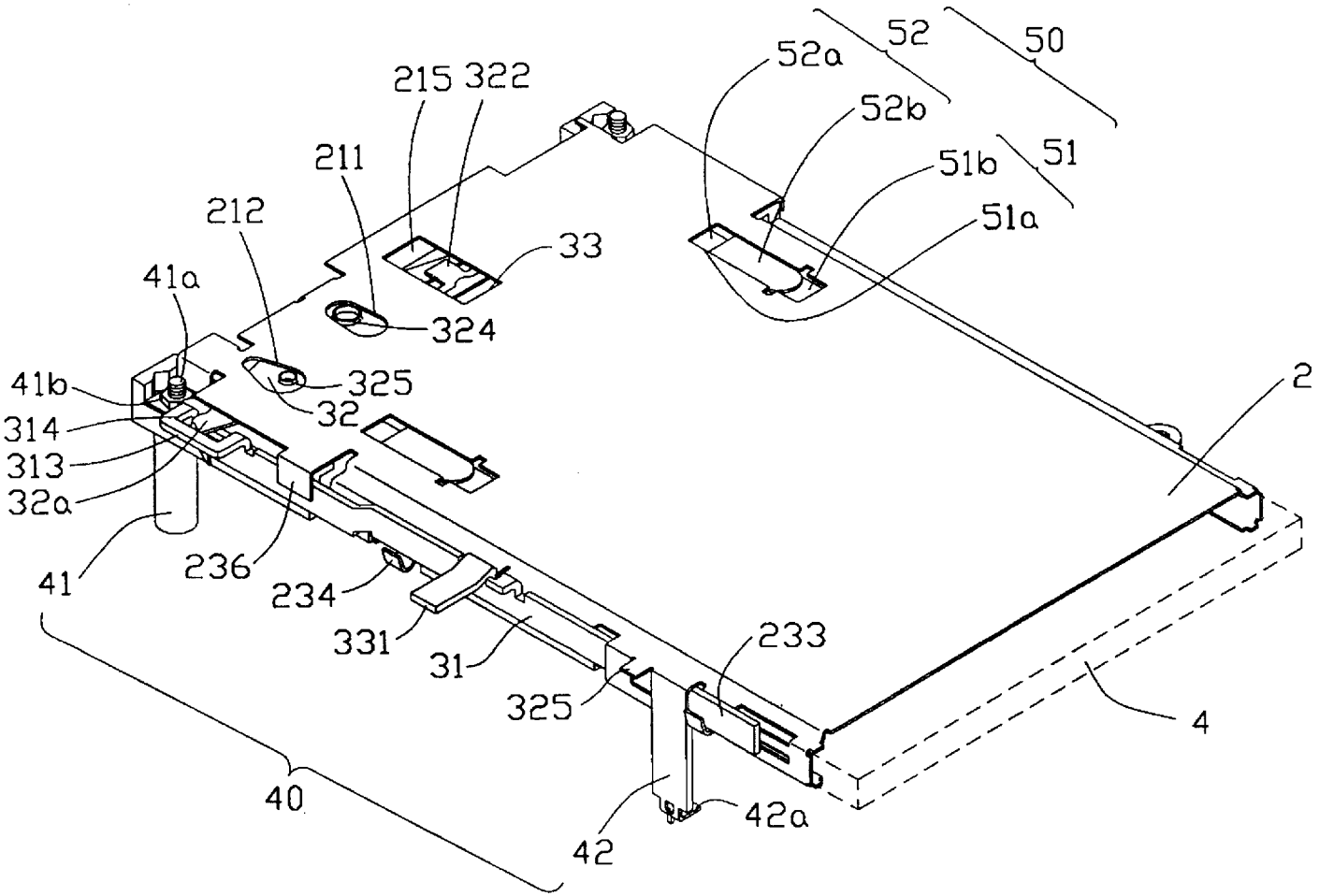
FIG. 2 is an assembled view of FIG. 1 with an inserted electrical card.

Referring to FIG. 1, a card connector in accordance with the present invention includes a dielectric terminal housing 1, a metal card housing 2, and an ejector mechanism 3. The elongate terminal housing 1 is formed with two guiding arms 12 at lateral ends thereof. A fixing plate 15 defining a number of openings 151 therethrough is disposed between the guiding arms 12. A recess 11 for receiving a bolt (not shown) is defined in each guiding arm 12 for fastening the terminal housing 1 to a printed circuit board (not shown). A plurality of first and second contacts 13, 14 are fixedly received in the terminal housing 1.

The rectangular card housing 2 is formed by a metal stamping procedure to have two U-shaped elongate side portions 22, 23 extending downward from opposite sides thereof. A pair of attaching portions 24 extend from opposite lateral sides of the card housing 2 for attachment to the PCB. A pair of guiding hooks 233, 234 and a pair of flanges 235, 236 extend from the side portion 23 defining a guiding passage 26. Guiding grooves 221, 231 are defined along inner faces of the side portions 22, 23 for guiding an electrical card 4 therethrough. A first shaft hole 211, a second shaft hole 212, a rectangular window 215, and guiding means 50 are all defined through a rear portion of the card housing 2.

A standoff device 40 is further provided to elevate the card connector above a motherboard. The standoff device 40 includes a pair of standoff posts 41 each having a threaded portion 41 a to engage with a nut 41*b* which is fixedly received within the recess 11. The standoff device 40 further includes a pair of standoff legs 42 extending from traverse side portions 22, 23. The standoff leg 42 includes a pad 42*a* for mounting onto the motherboard. By this arrangement, the card connector 1 is elevated above the motherboard and provides a robust space for other electronics.

The ejector mechanism 3 comprises an elongate push rod 31, an actuator 32, a rectangular ejection plate 33, and a spring (not shown). The push rod 31 forms an exerting projection 311 laterally extending from a middle portion thereof for receiving an external force from a user, a second engaging projection 312 adjacent to the exerting projection 311, and an L-shaped connecting member 313 at an end thereof defining an opening 314 therethrough. The actuator 32 forms a tongue 32*a* at one end thereof for movably engaging with the opening 314 of the push rod 31. The actuator 32 further defines an engaging aperture 326. First and second pivots 324, 325 project from a top surface thereof. The ejection plate 33 forms a pair of ejecting pads 331 downwardly extending from lateral ends thereof and an engaging tab 322 projecting from a rear edge thereof for engaging with the aperture 326 of the actuator 32.

A guiding device 50 is arranged between the card housing 2 and the ejection plate 33 of the ejector mechanism 3 and includes a pair of guiding slots 51 integrally defined on the metal housing 2 and a pair of guiding tongues 52 integrally formed on the ejection plate 33. The guiding slot 51 includes an opening 51*a* and a recessed portion 51*b*. The guiding tongue 52 includes a flat portion 52*a* and a raised portion 52*b*. The guiding tongue 52 can be assembled in the guiding slot 51 by extending the guiding tongue 52 through the opening 51*a*. After the guiding tongue 52 is completely seated, the raised portion 52*b* of the guiding tongue 52 is rested onto the recessed portion 51*b*, while the flat portion 52*a* is located within the recessed portion 51*b*. By this arrangement, when the ejection plate 33 is moved by the actuator 32, both ejecting pads 331 move simultaneously as guided by the guiding tongues 52 which move along the guiding slot 51. As a result, an inserted card can be smoothly ejected therefrom.

Figure 3:
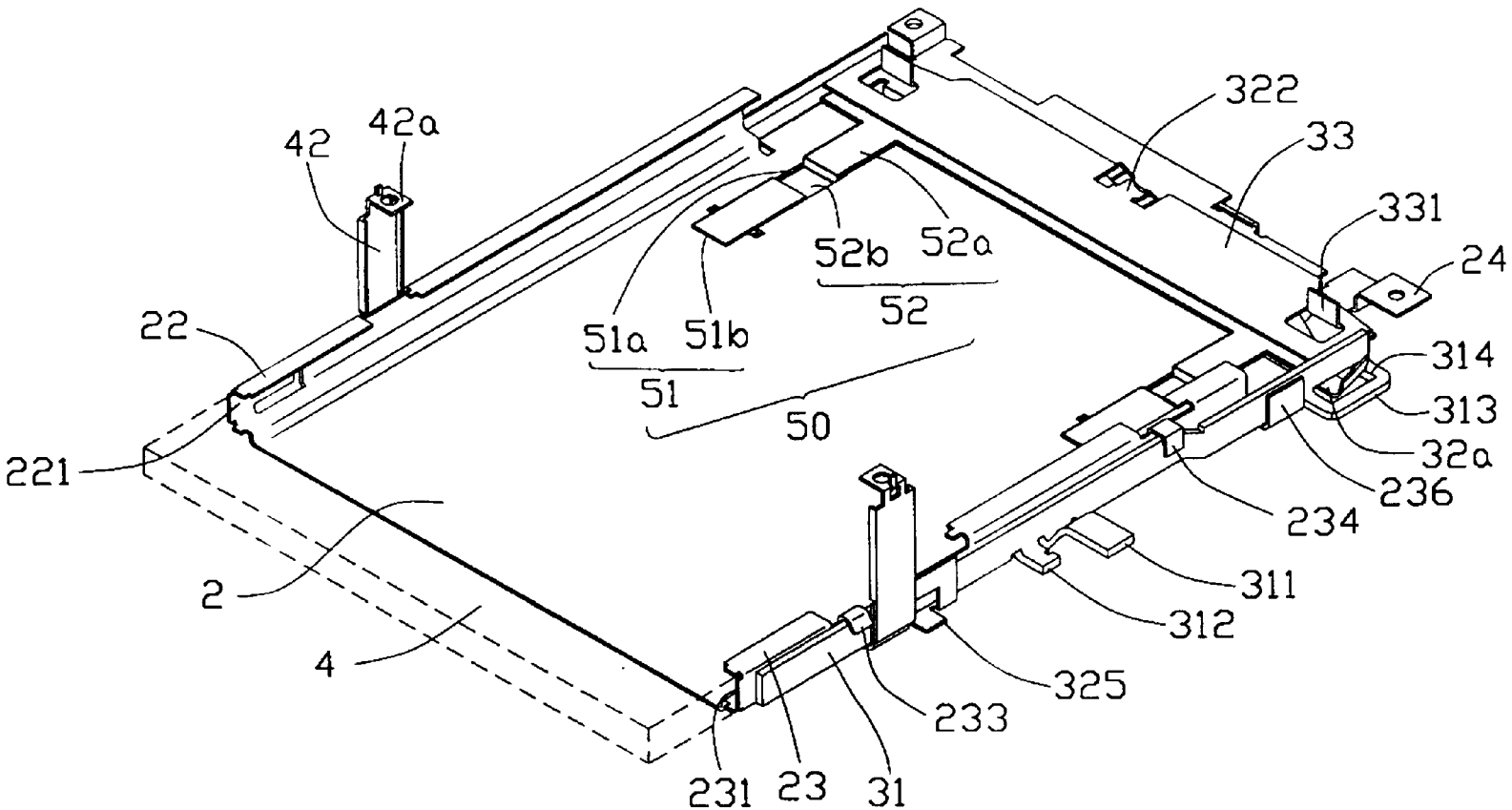
FIG. 3 is similar to FIG. 2 with a bottom faced upward.

FIG. 3 is an assembled perspective view of the metal card housing 2 and the ejector mechanism 3 together with a standoff device 40, the guiding device 50, and the electrical card 4 assembled thereto.

Figure 4:
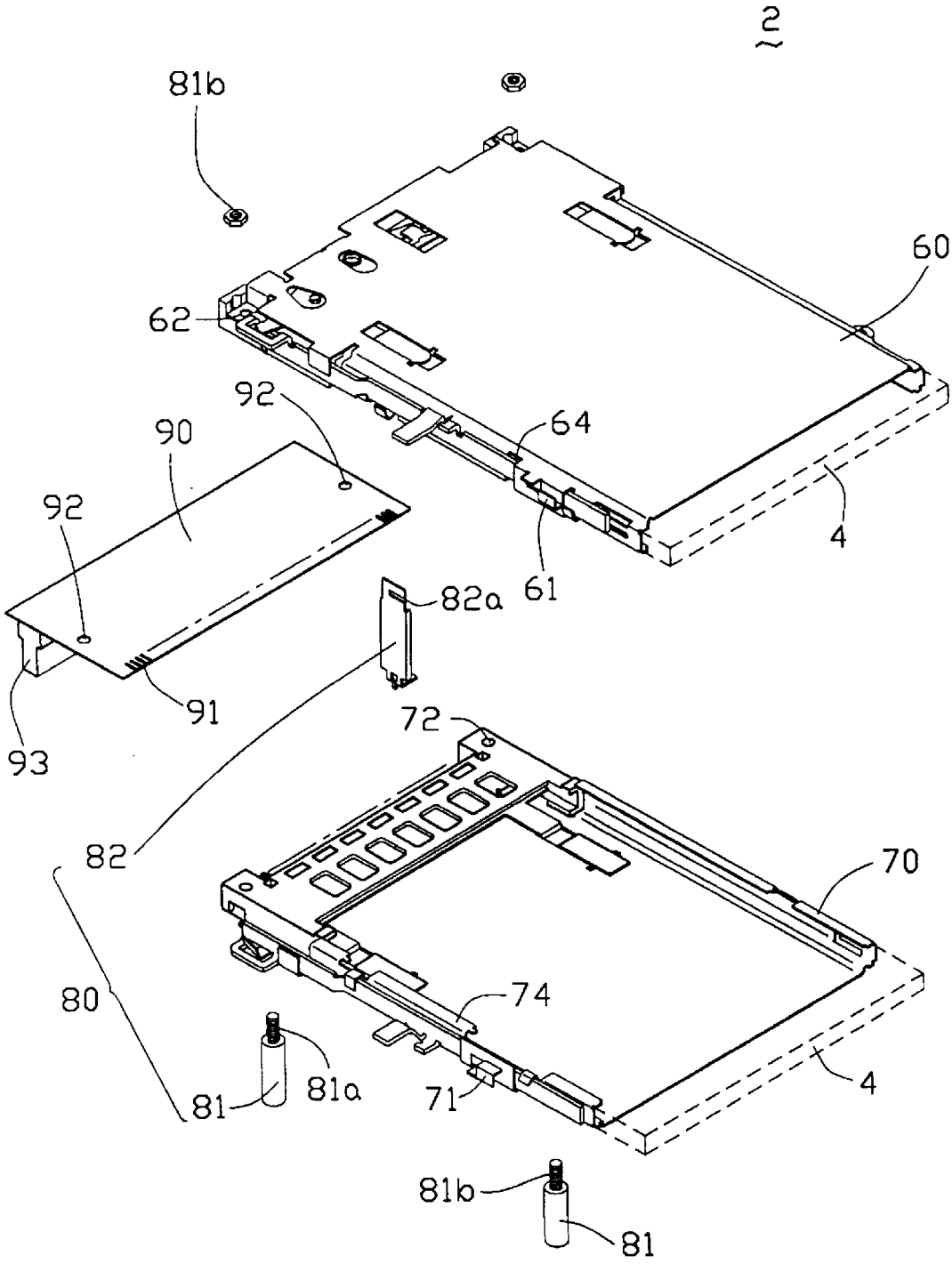
FIG. 4 is an exploded view of a card connector assembly in accordance with a second embodiment of the present invention.

Referring to FIG. 4, a card connector assembly 2A in accordance with a second embodiment of the present invention is shown. The card connector assembly 2A includes a first connector 60 and a second connector 70 stacked together. The first and second connectors 60, 70 are assembled by means of a standoff device 80 that includes a pair of standoff posts 81 and a pair of standoff legs 82. Each connector 60 (70) form a fastening lug 61 (71) at a side portion 64 (74) thereof The standoff leg 82 forms a retaining slot 82*a* in which the fastening lugs 61, 71 can be securely assembled. On the other hand, a threaded portion 81*a* of the standoff post 81 may also pass through the recesses 62, 72 to assemble the first and second connectors 60, 70 by means of a locking nut 81*b*.

Figure 5:
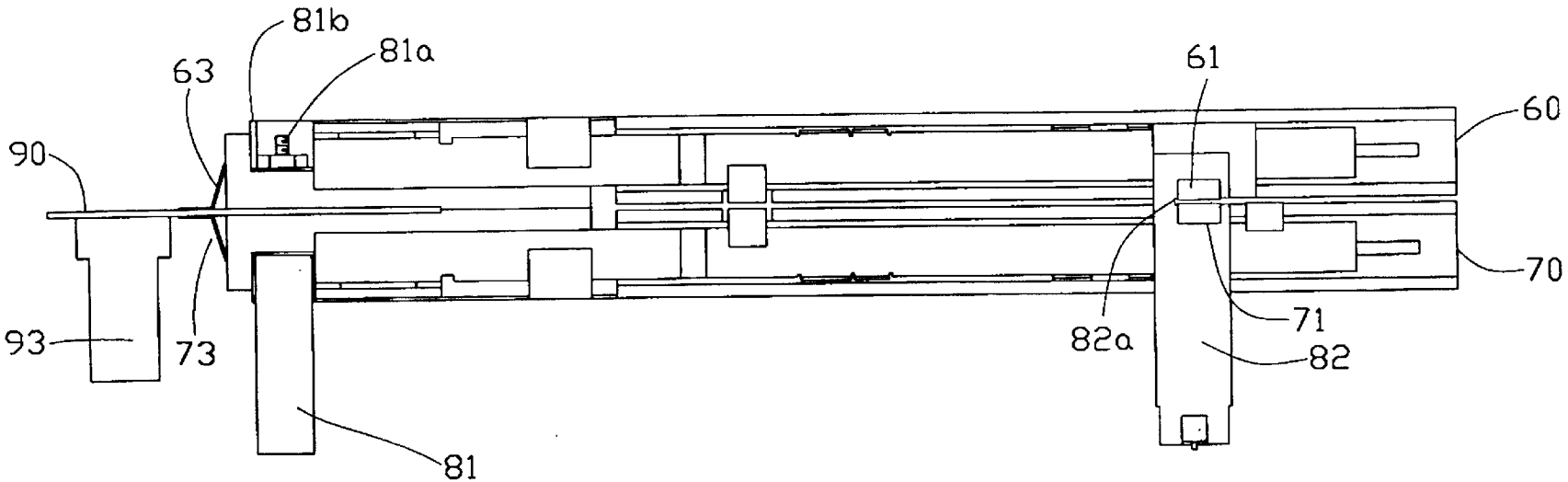
FIG. 5 is a side elevational view of FIG. 4.

In this embodiment, a printed circuit board 90 having conductive leads 91 are sandwiched between the first and second connectors 60, 70. The printed circuit board 90 further includes a pair of through holes 92 aligned to the recesses 62, 72 respectively. A mating connector 93 is attached to the printed circuit board 90 for electrically engaging with a corresponding connector on a motherboard (not shown). As shown in FIG. 5, a contact 63, 73 of the first and second connector 60, 70 are electrically connected with the conductive lead 91 of the printed circuit board 90.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A card connector for use with an electrical card, comprising:

a dielectric housing having a plurality of contacts securely assembled therein;

a metal card housing attached to said dielectric housing defining a space for receiving said electrical card;

an ejector mechanism for ejecting an inserted card assembled to said metal card housing; and a guiding device including at least a guiding slot defined on said metal card housing, and a guiding tongue integrally formed on an ejection plate of said ejector mechanism, said guiding tongue being moveably received within said guiding slot, wherein when a push rod of said ejector mechanism is moved, said ejector plate is evenly moved to eject said inserted card.

2. The card connector as recited in claim 1, wherein a standoff device is attached to said card connector whereby said card connector is elevated over a motherboard.

3. The card connector as recited in claim 2, wherein said standoff device includes at least a pair of standoff posts assembled to said dielectric housing to elevate said card connector over a motherboard.

4. The card connector as recited in claim 2, wherein said standoff device further includes a pair of standoff legs each extending downward from side portions of said metal card housing to elevate said card connector over a motherboard.

5. A card connector for use with an electrical card, comprising:

a dielectric housing having a plurality of contacts securely assembled therein;

a metal card housing attached to said dielectric housing defining a space for receiving said electrical card;

an ejector mechanism for ejecting an inserted card assembled to said metal card housing; and a guiding device including at least a guiding slot and a guiding tongue respectively positioned on said metal card housing and an ejection plate of said ejector mechanism, said guiding tongue being moveably received within said guiding slot, wherein when a push rod of said ejector mechanism is moved, said ejector plate is evenly moved to eject said inserted card.

* * * * *